United States Patent [19]

Brookstein et al.

[11] Patent Number: 4,602,892

[45] Date of Patent: Jul. 29, 1986

[54] SUCKER ROD

[75] Inventors: David S. Brookstein, Needham Heights; John Skelton, Sharon; Garrett C. Sharpless, West Newton, all of Mass.

[73] Assignee: Albany International Corporation, Menands, N.Y.

[21] Appl. No.: 297,762

[22] Filed: Aug. 31, 1981

[51] Int. Cl.[4] ..... B25G 3/34; F16B 11/00

[52] U.S. Cl. ..... 403/265; 403/343

[58] Field of Search ..... 403/343, 265

[56] References Cited

U.S. PATENT DOCUMENTS

| | | | |
|---|---|---|---|
| 2,874,937 | 2/1959 | Higgins | 403/277 X |
| 3,486,557 | 12/1969 | Harrison | 52/727 X |
| 4,063,838 | 12/1977 | Michael | 403/343 |
| 4,275,122 | 6/1981 | Fisher | 403/265 X |

*Primary Examiner*—Andrew V. Kundrat

*Attorney, Agent, or Firm*—Kane, Dalsimer, Kane

[57] ABSTRACT

The present invention envisions a concentric structural combination of elements, consisting of an elongate core component, which is terminated at each end on the internal surface of a chambered coupling, and a elongate sheath component which consists of an interlaced configuration of assemblies of non-metallic filamentary elements embedded in a polymer matrix, the sheath component being bonded at each end to the external surface of the coupling, the load-elongation characteristics of the core and sheath components being chosen so as to ensure that both components share substantially in the load-bearing under the working load conditions, with at least 50% of the load being borne by the aggregate of the non-metallic elements, and the sheath and matrix being disposed so as to substantially cover and protect the core and coupling components.

15 Claims, 8 Drawing Figures

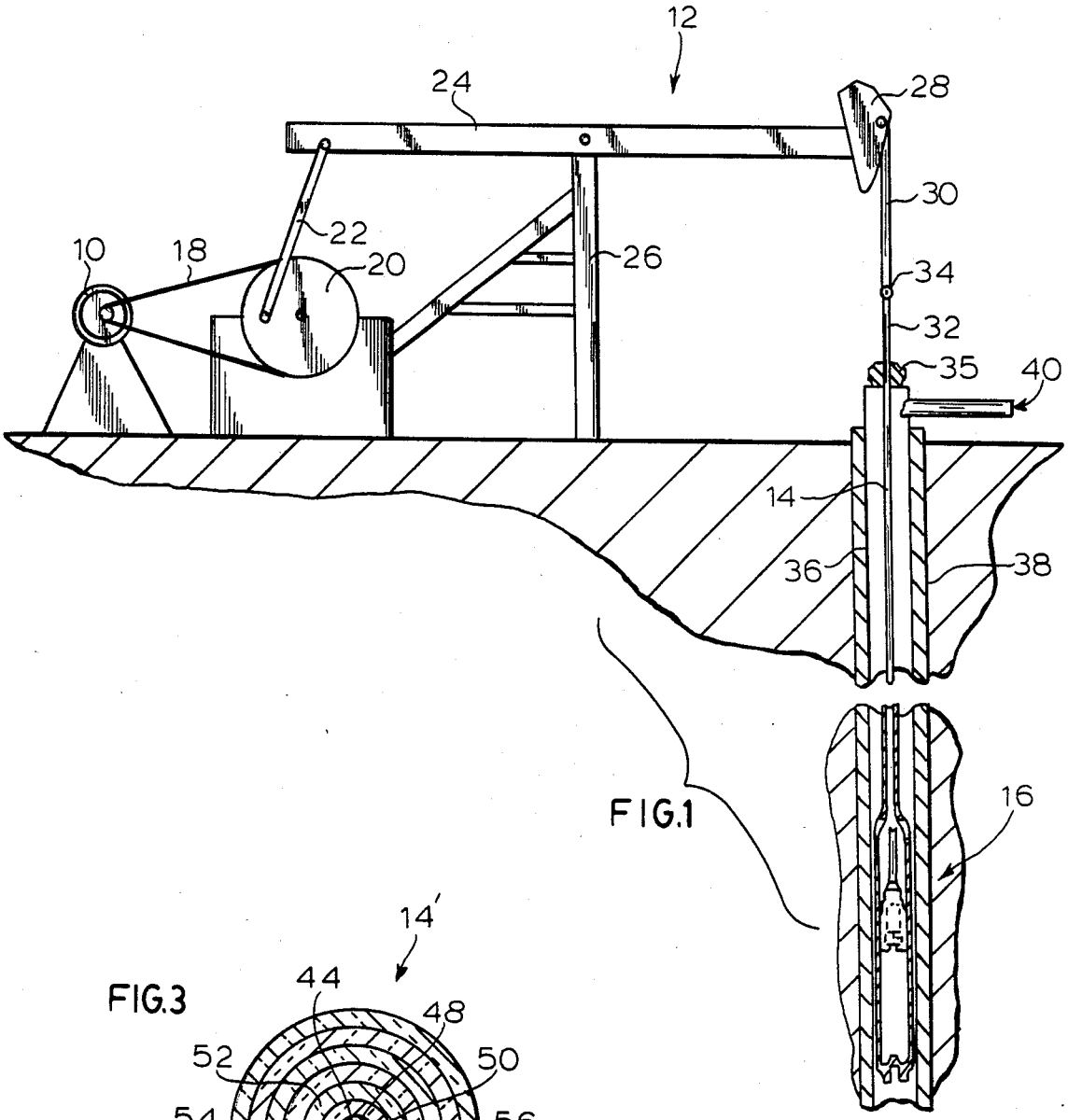
FIG.1
FIG.3
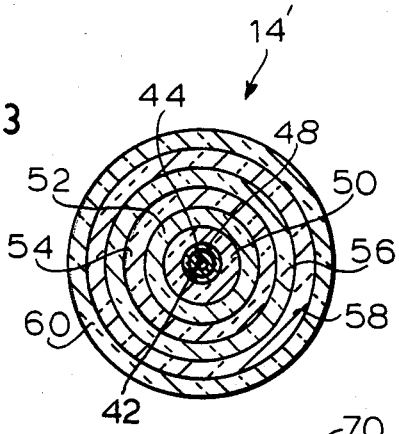
FIG.6
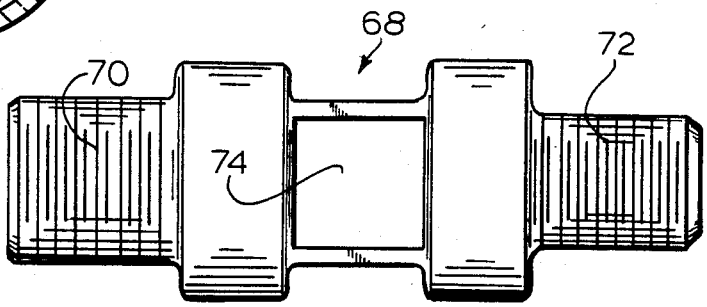

SUCKER ROD

BACKGROUND OF THE INVENTION

Conventional beam pumping installations for pumping fluid such as oil from underground locations utilize rods which are coupled in a continuous fashion to connect a surface pumping unit to an underground or subsurface downhole well pump for the purpose of transmitting mechanical energy from the surface equipment to the subsurface pump. The individual rods comprising the string are known as sucker rods and the plurality when coupled is referred to as a sucker rod string.

Subsurface oil well pumps are generally classified as either tubing or rod pumps. In the case of tubing pumps, the barrel is run on the tubing and the plunger is run on the rod string. In the case of rod pumps, the complete unit is run on the rod string. Rod pumps have the advantage of being more easily removed for servicing and are less susceptible to damage in running but they offer less working area for the plunger since the maximum bore of a rod pump is necessarily less than the maximum bore of a tubing pump for the same size tubing. In either case, however, pump travel length or plunger stroke is highly important in determining output, since the plunger stroke for any given pump when multiplied by the product of stroke rate and plunger area gives the volumetric productivity.

In the prior art publication "Well Design: Drilling and Production, Craft, B. C., Holden, W. R.,and Graves, E. P., Jr., Prentice-Hall Inc. 1962" it is taught that the effective plunger stroke downhole differs from the polished rod stroke; it is decreased by the effects of rod stretch resulting from fluid load and rod mass; and is increased by the effect of plunger overtravel. Since the magnitudes of these increases and decreases in stroke length are affected by the mechanical properties of the rods it is evident that the effective stroke downhole can be modified by suitable manipulation of the rod materials and characteristics, and this possibility has kead to considerable development effort in this area. In particular, it is interesting that modern data-logging and computational techniques, such as prescribed in SPE paper 588 by S. G. Gibbs presented at the Rocky Mountain Joint Regional Meeting, May 1963, of the Society of Petroleum Engineers of AIME permit the matching of sucker rod properties and the make-up of the sucker rod string to the operational parameters of a given well to achieve highly favorable pumping conditions, and hence, enhanced operational economics.

Early sucker rods were of all-metal construction as exemplified by U.S. Pat. No. 528,168 issued Oct. 30, 1894. Thereafter initial efforts to improve sucker rod performance were concerned with use of materials and design to resist corrosion and stress failure in view of the harsh environment of the well in which the rod is worked. These efforts are illustrated in prior art patents such as: U.S. Pat. No. 3,486,557 issued in 1969 to Harrison showing a rod comprising an inner cable surrounded by an encasement of molded plastic or fiberglass in an unspecified configuration wherein the end of the encasement has a conical recess to receive a splayed end of the cable which is held therein by metal introduced into the recess while molten and wherein the outer surface of the encasement is threaded to receive a connecting sleeve that serves to transfer load between adjacent sucker rods; U.S. Pat. No. 4,063,838 issued in 1977 to Michael showing a sucker rod having a solid steel core wrapped with resin-impregnated glass filaments in which the filaments form a stratified structure and the load transfer is via the outer surface of the wrapping in a manner similar to that described by Harrison. In this latter concept, however, the sheath material contains only helically wrapped filaments and is specifically designed to sustain compressive load in an attempt to maintain the core in a state of tension after the curing step.

It is interesting to note that as early as 1959 U.S. Pat. No. 2,874,937 to Higgins disclosed a sucker rod comprised of glass fibers held together by plastic resin. Intensive work has been undertaken in the field of fiberglass sucker rod design. Fiberglass is not seriously affected by corrosion, possesses a low specific gravity and has a high tensile strength-to weight ratio compared to steel.

In Paper SPE6851 presented at a technical meeting of SPE of AIME, Denver in October of 1977 Watkins and Haarsma described a continuous process for producing a high-volume-fraction glass rod in which glass filaments are collimated, saturated with resin, ordered into a circular configuration and cured. The paper presented data on the use of rods produced according to this process. The process has been referred to as the "pultrusion" process and the resulting rods have been referred to as "pultruded " fiberglass/resin composite rods.

Pultruded fiberglass sucker rods have a number of recognized positive attributes which include:

1. Higher Strength/Weight Ratio and Lower Rod Density than Steel Sucker Rods.

Lighter weight sucker rods allow the use of smaller pumpjacks and develop lower gear box loadings for a constant rate of production compared with those required for steel rods.

2. Good Corrosion Resistance/Low Electrical Conductivity.

Fiberglass/polyester composites have much greater resistance to corrosion than unprotected steel in the hostile environment found downhole. The downhole environment includes crude oil, $H_2S$, $CO_2$ and water at temperature up to 200° F., and furthermore, enhanced oil recovery techniques often result in increased concentration of corrosive elements. Rod strings consisting entirely of steel have been known to have useful lives of less than three months when employed in corrosive environment wells.

3. Opportunity for Increased Oil Well Productivity.

Fiberglass possesses an extensional modulus that is approximately $\frac{1}{3}$ that of steel. While fiberglass is considered generally to be a stiff material, when fabricated into sucker rods and subsequently installed in a deep (approx. 3,000 to 8,000 ft.) well, the resulting structure is sufficiently compliant that the reciprocating motion of the rod string is affected to a considerable extent. That is, when the motion of the upper end of the rod string changes direction, the ratio of the inertial forces to the elastic forces is such that the lower end of the rod string tends to continue along the original direction. As a consequence the stroke of the lower end of the rod string can be considerably longer than the stroke at the upper end. This phenomenon, referred to as "overtravel," results in enhanced productivity for a given pump stroke and rate.

4. Relatively Simple to Fabricate.

Fiberglass can be pultruded along with a variety of resin systems (for example, polyester, vinyl ester or epoxy) on a continuous basis through a constant cross-section die. The pultruded rods are then cut to length and adhesively bonded to metal couplings.

While pultruded fiberglass sucker rods have the aforementioned attributes, they also possess some significant shortcomings. These include:

1. Coupling Bond.

Pultruded fiberglass sucker rods are bonded to the coupling at only one surface. This single interface between the composite rod body and the metal coupling is somewhat vulnerable and prone to premature failure.

2. Metal Couplings Exposed to Corrosive Environment.

Pultruded fiberglass rods are usually terminated with a steel coupling. This coupling is exposed to the sour environment of the oil well and is subject to corrosion and to the possibility of stress-corrosion failure.

3. Reduced Torsional Properties

The uniaxial character of the fiberglass in the pultruded rod does not provide strength in torsion. While sucker rods are not generally loaded in the torsional mode, torsional loads might be applied to unstick a downhole pump, and if the unsticking torque exceeds the torsional strength of the pultruded rod, it will fail in shear.

4. Poor Compressive Properties

Compression properties which are critical during sucker rod use include: local axial compression which occurs when the rod rubs against the tubing wall or if the downhole pump sticks; and compression impact if the rods part and the lower portion falls to the bottom of the well. Despite the inherent damping of the motion of this free falling section by the oil in the tubing, compression impact can cause temporary loading which is responsible for both fiber buckling and subsequent "brooming" of the fiberglass. Usually, a pultruded rod is rendered useless when this occurs.

Local compression can also occur when the operator sets the downhole pump to eliminate the condition known as gas pound. In this case, the pump is set to slightly tap the bottom and the local compression that results is small in magnitude, but is continual in nature, and it is reputed to cause premature failure over the long term.

SUMMARY OF THE INVENTION

The desirable attributes of pultruded fiberglass sucker rods can be realized and their shortcomings minimized by the utilization of a unique combination of structural elements which include various polymers, metals and ceramics. Towards this end, the present invention envisions a concentric structural combination of elements, consisting of an elongate core component, which is terminated at each end on the internal surface of a chambered coupling, and a elongate sheath component which consists of an interlaced configuration of assemblies of non-metallic filamentary elements embedded in a polymer matrix, the sheath component being bonded at each end to the external surface of the coupling, the load-elongation characteristics of the core and sheath components being chosen so as to ensure that both components share substantially in the load-bearing under the working load conditions, with at least 50% of the load being borne by the aggregate of the non-metallic elements, and the sheath and matrix being disposed so as to substantially cover and protect the core and coupling components.

As an example of an embodiment of this invention, we consider a core component which consists of a steel wire rope covered with a sheath of load bearing fiberglass filaments oriented predominantly, but not exclusively, along the longitudinal axis of the wire rope, impregnated with a polymeric resin and subsequently cured. The wire rope core is terminated at each end within a hollow conical coupling, and the fiberglass sheath completely covers the core component wherever it is exposed between the couplings, and is bonded to the external surface of the conical couplings. By bonding we mean any effective means for the transfer of load between two components, including adhesive bonding as in this example, mechanical interlocking in surface rugosities, or topological constraints such as a wedge in a tapered chamber. In this way, both structural elements of the rods, namely the core and the sheath, are involved in the load bearing during use, with an attendant high coupling efficiency, and the vulnerable metallic core and coupling components are protected from the potentially harmful environment of the well.

In order to achieve improved torsional and compressive properties we incorporate into the sheath component filamentary elements that are aligned at an oblique angle to the longitudinal axial direction. These elements supply resistance to shear deformation of the assembly, and thus can increase the torsional strength by an appropriate design and also provide, under appropriate loading conditions, an inwardly-directed radial component of force that restricts the radial growth in the rod, and hence restricts or prevents "brooming." In order to produce a sheath structure that is as symmetrical as possible in its response to torsional strains it is helpful if the oblique elements are aligned in both the plus and minus angular directions as measured with respect to the longitudinal axis. In a filament winding process the oblique elements form an interleaved assembly. It is of considerable value however if the two sets of oblique elements form an interlaced assembly, both with themselves and with such longitudinal elements as may be present. In this way not only is the structural integrity of each layer of the sheath material improved, but it is also possible to achieve the greatest measure of control over the circumferential location of the longitudinal elements.

All the theoretical and practical considerations described above can be realized in the preferred embodiment of this invention, which utilizes a steel wire rope for the core and a triaxially braided fiberglass multilayered sheath, which provides the preferred interlaced configuration of assemblies of structural filaments which involve both longitudinal and oblique elements ordered in such a way as to provide adequate tensile, compressive and shear strength. In particular, the combination of wire rope core and fiberglass triaxial braid allows the development of a structure in which the load-elongation and ultimate elongation-to-break characteristics of both components are satisfactorily matched. Both core and sheath components are capable of independent adjustment of their tensile characteristics the properties of the wire rope can be manipulated by choice of construction and by the use of transversely compliant core material the properties of the braided sheath can be manipulated, inter alia, by the choice of non-metallic filamentary material, by alteration of the ratio of amount of longitudinal to oblique material in the system, by alteration of the angle of obliquity, and the overall density of the sheath assembly.

The large number of design options permitted by this particular combination of core and sheath components provides considerable design flexibility, and permits the realization of specific overall design parameters within the. framework of a practically viable manufacturing technique. For example, while the embodiment described above uses a steel cable as the core and fiberglass as the outer sheath, in order to exploit to the fullest extent the material/process interaction in this particular end-use application, it is possible that other end-use specifications could be more readily met by the use of alternative materials. These might include for the core tow or rod made from glass, carbon or other ceramic filaments, or from any of the available high strength organic filamentary materials, and for the sheath any of these or similar non-metallic materials.

Further, while the example described above envisions the use of adhesive bonding to secure the sheath to the coupling, the concept is not limited to this means of attachment. Geometric compatibility can be achieved by utilization of a wire rope with a transversely compliant core. Such a core enhance the elongation to break of the wire rope to the point where it is similar to that of the fiberglass overbraid.

BRIEF DESCRIPTION OF THE DRAWINGS

FIG. 1 is an elevation of a typical conventional beam pumping unit of the type used for pumping oil from a subsurface well and with which the present invention can be used;

FIG. 3 is a cross sectional view taken along the line 3—3 in the direction of the arrows in FIG. 2 showing the various concentric layers which combine to form the sucker rod shown in FIG. 2;

FIG. 6 is a longitudinal view of a composite rod end fitting which is used to connect individual sucker rods into the string;

DESCRIPTION OF THE PREFERRED EMBODIMENT

Figure 2:
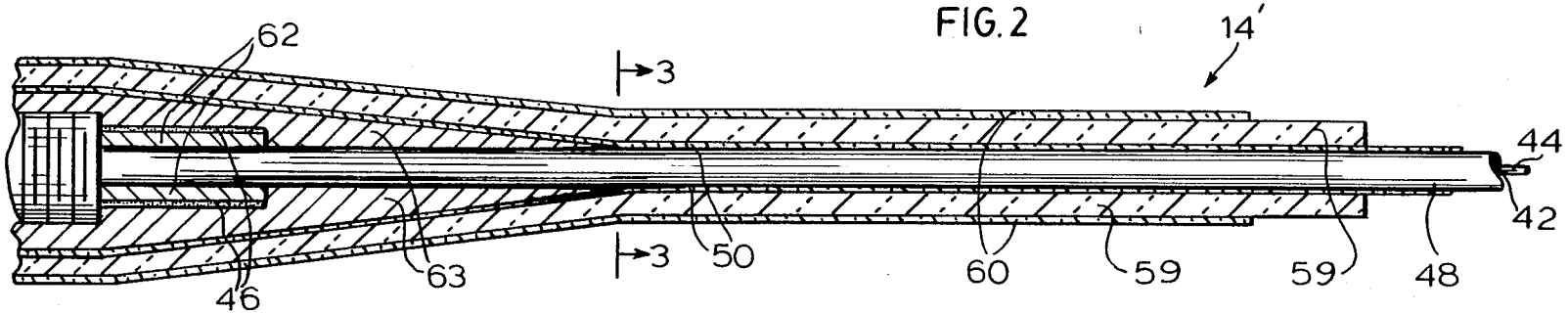
FIG. 2 is a longitudinal sectional segmentary view of a sucker rod constructed in accordance with the teachings of this invention.
Figure 4:
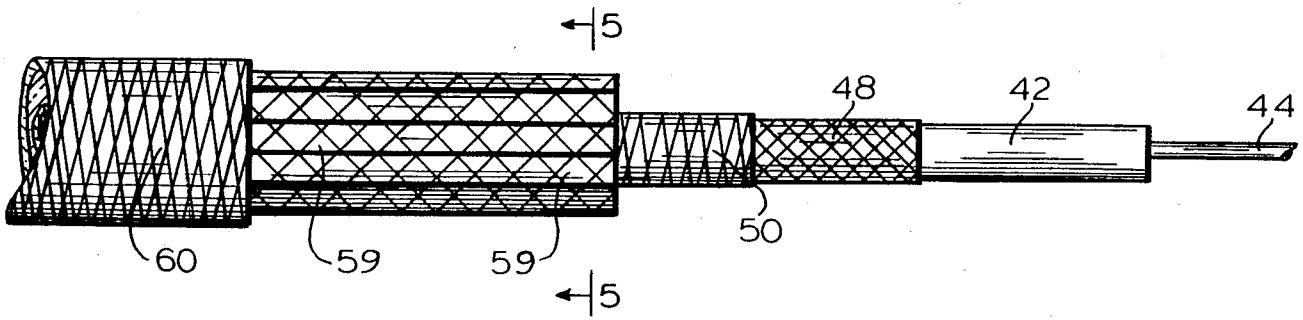
FIG. 4 is an enlarged segmentary longitudinal view taken generally in the vicinity of the section shown in FIG. 3 but with portions of the layers removed to illustrate the internal construction of the rod.

A conventional beam pumping system of the type used for pumping oil from a well and with which the present invention is used is shown in FIG. 1. The unit includes prime mover 10, surface pumping unit 12, sucker rod string 14 with sucker rods constructed in accordance with the teachings of this invention, and subsurface or downhole pump 16.

The function of the prime mover 10 is to supply to the installation mechanical energy which is eventually transmitted to the pump 16 and used to lift fluid. The prime mover selected for a given installation must have sufficient power output to lift fluid at the desired rate from the working fluid level in the well. Further, the load on the prime mover is a function of the weight of the sucker rod string 14. While pumping units are counterbalanced, the weight of the sucker rod affects not only the prime mover but the size of the pumping unit and required mechanical energy transmission components. And, of course, the load on the prime mover determines the energy requirement for pumping.

The subsurface pump 16 is provided to admit fluid from the formation in the well and to lift the fluid thus admitted to the surface.

The surface pumping unit indicated generally by the numeral 12 in the Figs. transfers energy for pumping the well 16 from the prime mover 10 to the sucker rod string 14. In doing this, it must change the rotary motion of the prime mover to reciprocating motion for the sucker rods, and it must reduce the speed of the prime mover to a rate suitable for pumping.

A surface pumping unit is rated by the peak torque capacity of its gear box. The API (American Petroleum Institute) designation for the unit is the maximum torque on the gear box rated in thousands of inch-pounds. Surface pumping units are also rated by the maximum vertical stroke. The stroke length and stroke rate determine the fluid lifting capability. Lightweight rods reduce the size requirement on the gear box and subsequently reduce the cost of the pumping unit for a given well productivity.

The surface pumping unit components shown in FIG. 1, in addition to the prime mover 10, include V-belt drive 18, crank arm 20, pitman arm 22, walking beam 24 pivotally connected to sampson post 26, horse's head 28, and hanger cable 30. Polished rod 32 is connected to the hanger cable by clamp 34. Rod 32 is projected within stuffing box 35 and the sucker rod string 14 is connected thereto.

Sucker rod string 14 is suspended within tubing 36 which itself is projected within the hole by casing 38. Flowline 40 is indicated as being connected to tubing 36.

The preferred embodiment of the sucker rod of this invention is shown in detail in FIGS. 2 through 5.

The rod construction includes a concentric combination of steel wire helically stranded rope 42 containing a transversely compliant polymer core 44 fixed at one end in steel coupling 63 and a triaxially braided fiberglass reinforced resin elongate sheath which is corrosion resistant and possesses a high strength-to-weight ratio. It is comprised of seven concentric layers as seen in FIG. 3 where the layers are designated by the numerals 48, 50, 52, 54, 56, 58 and 60 respectively. (For ease of illustration the layers 52, 54, 56 and 58 are shown as one in FIGS. 2, 4 and 5 and designated by the numeral 59.)

Wire rope 42 ($\frac{3}{8}$" fiber core) is a stranded structure of low tensile modulus which is comparable to that of fiberglass and is of high tensile strength. The transversely compliant polymer core increases the strain-to-break property of the wire rope so that it is in the immediate range of the strain-to-break property of the longitudinally ordered fiberglass structural elements.

The resulting combination of structural elements provides a tensile structure wherein each component bears axial loading at similar ratios of ultimate load and strain to break in a structurally efficient manner.

The utilization of braiding allows opportunity for pump overtravel for many configurations with high strength-to weight ratios. The braided sheath increases the torsional strength and provides "off-axis" reinforcement and improves the compressive properties of the combination.

At the coupling 63 a swage coupling 62 is employed to secure the wire rope 42. The swage coupling 62 is bonded with adhesive 46 to the steel coupling 63.

In the preferred embodiment braid layer 48 is a triaxial braid with cross yarns at 45° to the rod axis. There are thirty-two yarns with sixteen having a right hand obliquity and sixteen having left hand obliquity (16×16). Each yarn possesses a linear density specified by a yield of 2500 yds/lb. There are sixteen longitudinal yarns interlaced with the oblique yarns having a linear density specified by a yield of 231 yds/lb.

Layer 50 is conventional braid construction of 16×16 oblique yarns utilizing yarns specified by a yield of 2500 yd/lb at a high angle to the rod axis. This layer is provided in this form only at the smaller diameter termination of steel coupling 63 to provide mechanical strength as an aid in reducing the tendency to debond at the adhesive interface.

Figure 5:
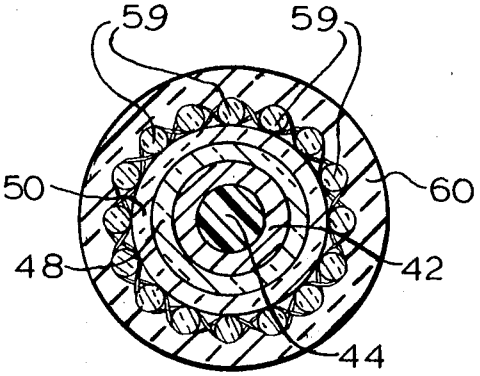
FIG. 5 is a diagrammatic view somewhat similar to FIG. 3 but somewhat more detailed.

Layers 52, 54, 56 and 58 are all the same with a construction somewhat like that of layer 48, that is, 16×16 cross yarns at 45° to the rod axis and having a linear density specified by a yield of 2500 yds/lb. There are 16 longitudinal yarns interlaced with the cross yarns. The linear density of these yarns is specified by a yield of 107 yds/lb. It has been found undesirable to use lengthwise yarns with this high linear density in layer 48 since there is not sufficient room to accomodate the cross sectional area of these yarns in a single, compact layer. FIG. 5 illustrates the lengthwise yarns held in position in the triaxial braid portion of the sheath which insures the integrity of the structure.

The final layer 60 is a 48×48 braid of conventional construction utilizing yarns specified by a yield of 2500 lbs/yd. The layer contributes to the torsional strength and provides a smooth outer surface to the rod assemblies.

Figure 7:
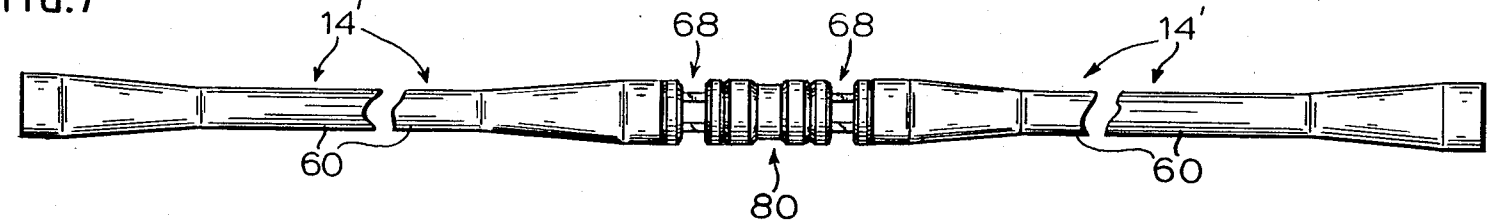
FIG. 7 is a longitudinal view of two complete sucker rods of the invention joined together by a composite rod end fitting of the type shown in FIG. 6.
Figure 8:
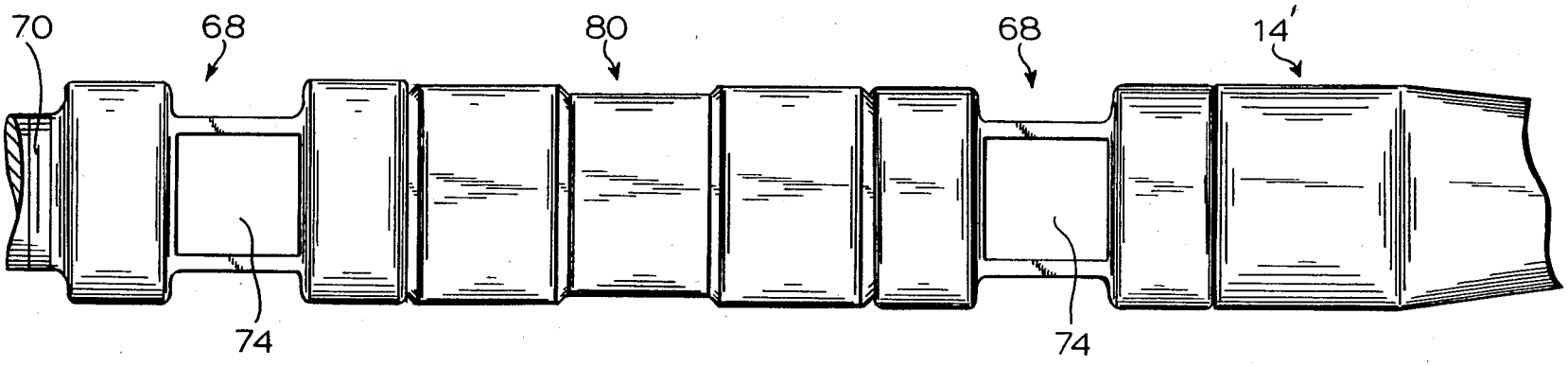
FIG. 8 is a detailed view of the rod end fitting.

There is shown in FIG. 6 a composite rod end fitting 68 which can be used to connect sucker rod into the string. Fitting 68 includes two male ends 70 and 72 with flats 74 provided for use with a wrench. As seen in FIG. 7 each sucker rod (designated therein by the numeral 14') contains two couplings 46 - one at either end, and fitting 68 is provided to engage one end of each rod to present a threaded male surface for attachment to the female coupling 80 which is used to attach adjacent rods.

During braiding, a resin system is applied to the entire rod structure to impregnate the fiberglass. The number of layers of fiberglass yarns which are braided, the ratio of linear densities of axial yarn to cross yarns, and the braid angle can be adjusted over a wide range to affect total system modulus and hence plunger overtravel. Further, this is accomplished while maintaining the sucker rod strength within a range suitable for oil well pumping. The steel wire rope and the oblique sets of ply fiberglass yarns contribute to the torsional strength of the rod. Also it may be desireable in certain applications to include a filamentary component in the external layer of the sheath which by its nature and disposition will mechanically protect the interior load bearing elements.

When designated for use in a rod string the extensional modulus of the string can be adjusted by choice of core and sheath components, and in the method of combining these components to optimize the sum of overtravel minus rod stretch for desired operating parameters.

We claim:

1. A sucker rod assembly including
an elongate core component,
a coupling,
a chamber of said coupling,
an end of said elongate core component within said chamber,
means for retaining said end within said chamber,
an elongate sheath component consisting of an interlaced configuration of assemblies of non-metallic filamentary elements embedded in a polymeric matrix, and said sheath bonded to the external surface of said coupling.

2. A sucker rod assembly in accordance with claim 1 in which the load-elongation characteristics of the core and sheath assemblies are selected so that the core and sheath components share substantially in the load-bearing under the working load conditions.

3. A sucker rod assembly in accordance with claim 1 constructed and arranged so that at least 50% of the load under the working conditions is borne by the aggregate of the nonmetallic elements.

4. A sucker rod assembly in accordance with claim 1 in which said interlaced configuration of non-metallic elements form a braided structure.

5. A sucker rod assembly in accordance with claim 1 in which said sheath includes a first set of yarns thereof extending in the direction of said elongate core component, remaining yarns thereof enveloping said elongate core component and said coupling at angles to said first set of yarns.

6. A sucker rod assembly in accordance with claims 4 or 5 in which said sheath is a triaxially braided structure.

7. A sucker rod assembly as defined in claims 1, 2, 3, 4, or 5 in which the filamentary elements of said sheath are fiberglass and said elongate core component is a stranded cable of low tensile modulus and high tensile strength.

8. A sucker rod assembly as defined in claims 1, 2, 3, or 4 in which the filamentary elements of said sheath are fiberglass and said elongate core component is a pultruded fiberglass rod.

9. A sucker rod assembly in accordance with claim 7 in which said elongate component includes a transversely compliant center core whereby the extension-to-break characteristic of the elongate core component is increased.

10. A sucker rod assembly as defined in claims 1, 2, 3, 4, or 5 in which said said sheath is resin-impregnated fiberglass and said elongate core component is a stranded cable wherein the strains to break of the sheath and elongate member are substantially equal.

11. A sucker rod assembly as defined in claims 1, 2, 3, 4, or 5 in which said means for retaining includes a swage having a central bore through which said end portion of said elongate core component extends, said swage having exterior walls conforming to the shape of and positioned substantially flush against the interior walls of the remaining end of said coupling.

12. An assembly as defined in claim 1 wherein said elongate core and said coupling are ensheathed by a plurality of layers of fiberglass sheaths, at least one of said layers being triaxially braided and at least one of said layers being conventionally braided without longitudinally oriented yarns.

13. A rod assembly including an elongate core component and an elongate sheath component thereof consisting of an interlaced configuration of assemblies of non-metallic filamentary elements embedded in a polymeric matrix and in which the load-elongation characteristics of the core and sheath assemblies are selected and the core and sheath assemblies are arranged so that the core and sheath components share substantially in the load bearing and in which the filamentary elements of said sheath are fiberglass and said elongate core component is a stranded cable of low tensile modulus and high tensile strength.

14. A rod assembly in accordance with claim 13 in which said elongate component includes a transversely compliant center core whereby the extension-to-break characteristic of the elongate component is increased.

15. A rod assembly in accordance with claim 14 in which said sheath is resin-impregnated fiberglass and said elongate component is a stranded cable wherein the strains to break of the sheath and elongate member are substantially equal.

* * * * *